US010177454B1

(12) United States Patent
Patel

(10) Patent No.: US 10,177,454 B1
(45) Date of Patent: Jan. 8, 2019

(54) LUMPED ELEMENT TENSOR IMPEDANCE SURFACES

(71) Applicant: HRL Laboratories, LLC, Malibu, CA (US)

(72) Inventor: Amit M. Patel, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 243 days.

(21) Appl. No.: 15/344,363

(22) Filed: Nov. 4, 2016

(51) Int. Cl.

| | |
|---|---|
| ***H01Q 1/50*** | (2006.01) |
| ***H01Q 9/04*** | (2006.01) |
| ***H01Q 5/335*** | (2015.01) |
| ***H01Q 1/48*** | (2006.01) |
| ***H01Q 15/00*** | (2006.01) |

(52) U.S. Cl.
CPC ..... *H01Q 9/0485* (2013.01); *H01Q 1/48* (2013.01); *H01Q 5/335* (2015.01); *H01Q 15/0086* (2013.01)

(58) Field of Classification Search
CPC ..... H01Q 9/0485; H01Q 5/335; H01Q 1/48; H01Q 15/0086
See application file for complete search history.

(56) References Cited

U.S. PATENT DOCUMENTS 7,813,310 B2 * 10/2010 Song ..... H04H 20/30 370/312
7,830,310 B1 11/2010 Sievenpiper et al.
7,911,407 B1 3/2011 Fong et al.
8,976,077 B2 3/2015 Colburn et al.
2015/0009071 A1 * 1/2015 Gregoire ..... H01Q 3/34 342/372

OTHER PUBLICATIONS

B. Fong et al, "Scalar and Tensor Holographic Artificial Impedance Surfaces," IEEE TAP., vol. 58, No. 10, Oct. 2010, pp. 3212-3221.
Patel, A.M.; Grbic, A., "Modeling and Analysis of Printed-Circuit Tensor Impedance Surfaces," IEEE Transactions on Antennas and Propagation, vol. 61, No. 1, Jan. 2013, pp. 211-220.
D. Sievenpiper et al, "Holographic AISs for Conformal Antennas", 29th Antennas Applications Symposium, 2005, pp. 256-259.
D. Sievenpiper, J. Colburn, B. Fong, J. Ottusch and J. Visher., 2005 IEEE Antennas and Prop. Symp. Digest, vol. 1B, 2005, pp. 256-259.
D.J. Gregoire and J.S. Colburn, "Artificial Impedance Surface Antennas", Proc. Antennas Appl. Symposium 2011, pp. 460-475.
D.J. Gregoire and J.S. Colburn, "Artificial Impedance Surface Antenna Design and Simulation", Proc. Antennas Appl. Symposium 2010, pp. 288-303.

(Continued)

*Primary Examiner* — Dameon E Levi
*Assistant Examiner* — David Lotter
(74) *Attorney, Agent, or Firm* — Ladas & Parry

(57) ABSTRACT

A tensor impedance surface including a plurality of unit cells, wherein each unit cell includes a dielectric having a thickness, a first surface of the dielectric having a metallic pattern on the first surface, and at least one lumped element coupled between a first point on the metallic pattern and a second point on the metallic pattern. Each unit cell of the plurality of unit cells has a first thickness and has an identical metallic pattern. Each unit cell of the plurality of unit cells is adjacent to one or more unit cells of the plurality of the unit cells.

22 Claims, 9 Drawing Sheets

(56) References Cited

OTHER PUBLICATIONS

Colburn, J.S.; Lai, A.; Sievenpiper, D.F.; Bekaryan, A.; Fong, B.H.; Ottusch, J.J.; Tulythan, P.; , "Adaptive Artificial Impedance Surface Conformal Antennas," Antennas and Propagation Society International Symposium, 2009. APSURSI '09. IEEE , vol., No., pp. 1-4, Jun. 1-5, 2009.

Sievenpiper, D.; Schaffner, J.; Lee, J.J.; Livingston, S. "A Steerable Leaky-Wave Antenna Using a Tunable Impedance Ground Plane," Antennas and Wireless Propagation Letters, IEEE , vol. 1, No. 1, pp. 179-182, 2002.

D. J. Gregoire and A. V. Kabakian, "Surface-Wave Waveguides," Antennas and Wireless Propagation Letters, IEEE 10, 2011, pp. 1512-1515.

G. Gok and A. Grbic, "Tensor Transmission-Line Metamaterials," IEEE Transactions on Antennas and Propagation, vol. 58, No. 5, pp. 1559-1566, May 2010.

Patel, A.M.; Grbic, A., "A Printed Leaky-Wave Antenna Based on a Sinusoidally-Modulated Reactance Surface," IEEE Transactions on Antennas and Propagation, vol. 59, No. 6, Jun. 2011, pp. 2087-2096.

Quarfoth, R.; Sievenpiper, D., "Broadband Unit—Cell Design for Highly Anisotropic Impedance Surfaces," IEEE Transactions on Antennas and Propagation, vol. 62, No. 8, Aug. 2014, pp. 4143-4152.

Luukkonen, O.; Simovski, C.; Granet, G.; Goussetis, G.; Lioubtchenko, D.; Raisanen, A.V.; Tretyakov, S.A., "Simple and Accurate Analytical Model of Planar Grids and High-Impedance Surfaces Comprising Metal Strips or Patches," IEEE Transactions on Antennas and Propagation, vol. 56, No. 6, Jun. 2008, pp. 1624-1632.

* cited by examiner

C1 = 80 fF
C2 = 50 fF
C3 = 0.15 pF

C1 = 0.2 pF
L2 = 4.5 nH
C3 = 0.18 pF

LUMPED ELEMENT TENSOR IMPEDANCE SURFACES

CROSS REFERENCE TO RELATED APPLICATIONS

This application is related to U.S. Pat. No. 7,911,407 issued Mar. 22, 2011, U.S. Pat. No. 7,830,310 issued Nov. 9, 2010, and PCT/US2012/032648 filed Apr. 6, 2012, which are incorporated herein as though set forth in full.

STATEMENT REGARDING FEDERAL FUNDING

None

TECHNICAL FIELD

This disclosure relates to tensor impedance surfaces, and in particular to anisotropic tensor impedance surfaces.

BACKGROUND

Prior art tensor impedance surfaces using printed-circuit are described in References 1, 2 and 12 below, which are incorporated herein by reference. The impedance surfaces described in those references rely on metal patterns on the printed circuit to provide impedance variation and anisotropy. Such an impedance surface has a number of disadvantages including etching variations, which affect impedance, and limitations on the range of impedance that can be achieved. For example, the ratio of the smallest to the largest impedance may be limited.

Tunable surfaces with varactors are described in Reference 7 below, which is incorporated herein by reference. These tunable surfaces have the disadvantages of cost and complexity because of the required tuning elements, bias lines, and other circuit complexities.

Tensor transmission line metamaterials, as described in Reference 10 below, which is incorporated herein by reference, have the disadvantage that they only apply to transmission line modes. Tensor transmission line metamaterials do not work for or apply to surface waves which have many real-world applications. Transmission line metamaterials may use lumped elements to realize values of epsilon and mu. For example, Reference 10 describes a circuit model that has a shunt element to ground.

Sinusoidally modulated impedance surfaces as described in References 1, 3, 5, and 11 below, which are incorporated herein by reference, have been used to control surface waves in a manner to achieve directive radiation; however, they do not operate well to control polarization.

REFERENCES

The following references are incorporated by reference as though set forth in full.

1. B. Fong et al, "Scalar and Tensor Holographic Artificial Impedance Surfaces," IEEE TAP., 58, 2010.
2. Patel, A. M.; Grbic, A., "Modeling and Analysis of Printed-Circuit Tensor Impedance Surfaces," *Antennas and Propagation, IEEE Transactions on*, vol. 61, no. 1, pp. 211, 220, January 2013.
3. D. Sievenpiper et al, "Holographic AISs for conformal antennas", 29th Antennas Applications Symposium, 2005.

4. D. Sievenpiper, J. Colburn, B. Fong, J. Ottusch and J. Visher., 2005 IEEE Antennas and Prop. Symp. Digest, vol. 1B, pp. 256-259, 2005.
5. D. J. Gregoire and J. S. Colburn, Artificial impedance surface antennas, Proc. Antennas Appl. Symposium 2011, pp. 460-475.
6. D. J. Gregoire and J. S. Colburn, Artificial impedance surface antenna design and simulation, Proc. Antennas Appl. Symposium 2010, pp. 288-303.
7. Colburn, J. S.; Lai, A.; Sievenpiper, D. F.; Bekaryan, A.; Fong, B. H.; Ottusch, J. J.; Tulythan, P.; "Adaptive artificial impedance surface conformal antennas," Antennas and Propagation Society International Symposium, 2009. APSURSI '09. IEEE, vol., no., pp. 1-4, 1-5 Jun. 2009.
8. Sievenpiper, D.; Schaffner, J.; Lee, J. J.; Livingston, S. "A steerable leaky-wave antenna using a tunable impedance ground plane," Antennas and Wireless Propagation Letters, IEEE, vol. 1, no. 1, pp. 179-182, 2002.
9. D. J. Gregoire and A. V. Kabakian, "Surface-Wave Waveguides," Antennas and Wireless Propagation Letters, IEEE 10, 2011, pp. 1512-1515.
10. G. Gok and A. Grbic, "Tensor transmission-line metamaterials," IEEE Transactions on Antennas and Propagation, vol. 58, no. 5, pp. 1559-1566, May 2010.
11. Patel, A. M.; Grbic, A., "A Printed Leaky-Wave Antenna Based on a Sinusoidally-Modulated Reactance Surface," IEEE Transactions on Antennas and Propagation, vol. 59, no. 6, pp. 2087-2096, June 2011.
12. Quarfoth, R.; Sievenpiper, D., "Broadband Unit-Cell Design for Highly Anisotropic Impedance Surfaces," IEEE Transactions on Antennas and Propagation, vol. 62, no. 8, pp. 4143-4152, August 2014.
13. Luukkonen, O.; Simovski, C.; Granet, G.; Goussetis, G.; Lioubtchenko, D.; Raisanen, A. V.; Tretyakov, S. A., "Simple and Accurate Analytical Model of Planar Grids and High-Impedance Surfaces Comprising Metal Strips or Patches," Antennas and Propagation, IEEE Transactions on, vol. 56, no. 6, pp. 1624, 1632, June 2008.

What is needed is a tensor impedance surface and a method of making a tensor impedance surface capable of achieving a wide range of impedance values and anisotropy to provide phase direction control, power direction control, and polarization control. The embodiments of the present disclosure answer these and other needs.

SUMMARY

In a first embodiment disclosed herein, a tensor impedance surface comprises a plurality of unit cells, wherein each unit cell comprises a dielectric having a thickness, a first surface of the dielectric having a metallic pattern on the first surface, and at least one lumped element coupled between a first point on the metallic pattern and a second point on the metallic pattern, wherein each unit cell of the plurality of unit cells has a first thickness, wherein each unit cell of the plurality of unit cells has an identical metallic pattern, and wherein each unit cell of the plurality of unit cells is adjacent to one or more unit cells of the plurality of the unit cells.

In another embodiment disclosed herein, a method of providing a tensor impedance surface comprises providing a plurality of unit cells, wherein each unit cell comprises a dielectric having a thickness, a first surface of the dielectric having a metallic pattern on the first surface, and at least one lumped element coupled between a first point on the metallic pattern and a second point on the metallic pattern, wherein each unit cell of the plurality of unit cells has a first thickness, wherein each unit cell of the plurality of unit cells has an identical metallic pattern, and wherein each unit cell of the plurality of unit cells is adjacent to one or more unit cells of the plurality of the unit cells.

These and other features and advantages will become further apparent from the detailed description and accompanying figures that follow. In the figures and description, numerals indicate the various features, like numerals referring to like features throughout both the drawings and the description.

DETAILED DESCRIPTION

Figure 1:
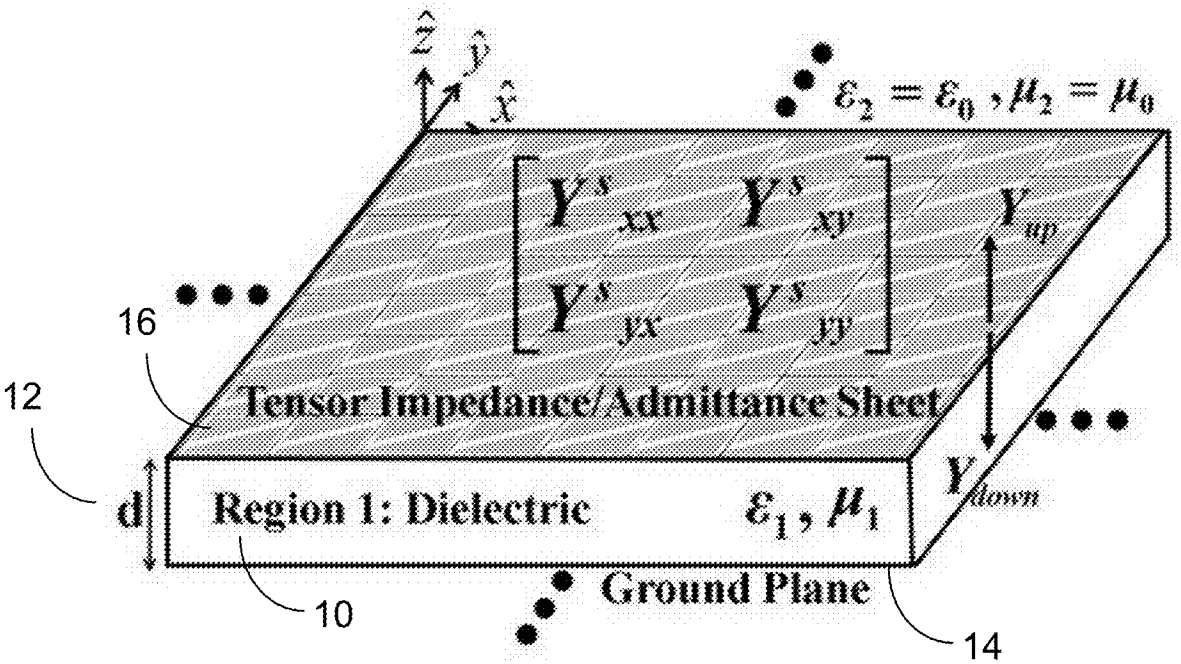
FIG. 1 PRIOR ART
FIG. 1 shows an analytical model for a printed-circuit tensor impedance surface (PCTIS) consisting of a sub-wavelength patterned metallic cladding over a grounded dielectric substrate in accordance with the prior art.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The present disclosure describes tensor impedance surfaces capable of achieving a wider range of impedance values and greater degrees of anisotropy than the prior art using printed circuit board-based impedance surfaces, such as those described in References 1, 2 and 12 above. The tensor impedance surfaces of the present disclosure allow control of phase direction, power flow direction, and polarization, and may be realized on a dielectric substrate, which may or may not be grounded. The dielectric substrate may be a printed-circuit board. In the present disclosure unit cells are provided and each unit cell has a metallic pattern on the surface. The metallic pattern may be loaded with surface mount lumped elements, such as capacitors, inductors, diodes or resistors. The present disclosure method of loading the metallic pattern with lumped elements provides an inverse design procedure that allows the lumped element values to be directly derived to provide a desired impedance surface. This is in contrast to the prior art, which requires cataloging the behavior of hundreds or thousands of unit cell geometries through simulation, and then selecting unit cells that approximately provide a desired impedance property.

Impedance surfaces have many applications including electrically-scanned antennas, electromagnetic scattering, reflector arrays, and waveguides, as described in References 3 to 9 above, which are incorporated herein by reference. The present disclosure increases design flexibility by relaxing the constraints on realizable impedance surfaces.

While impedance surfaces properties in the prior art have been achieved by patterning metal over a grounded dielectric substrate, the present disclosure describes devices and methods for achieving a wider range of properties beyond those achievable with just metallic patterning. Impedance surfaces formed in accordance with the present disclosure can have larger impedance ranges and greater ranges of anisotropy than previously available in the prior art using just patterned metallic claddings. Further, a circuit model can be used to aids synthesis of the tensor impedance surfaces, which may also be scalar impedance surfaces. Also, the tensor impedance surfaces of the present disclosure avoid the high fabrication cost, complexity, and losses incurred using prior art varactor loaded impedance surfaces. An added advantage is that the present disclosure allows tensor impedance surfaces to be made thinner since capacitance is no longer dependent on only a substrate thickness. Also, although the present disclosure is used to control surface waves rather than guided transmission line modes, devices designed using the present disclosure may resemble a transmission line loaded with lumped elements.

FIG. 1 shows an analytical model for a printed-circuit tensor impedance surface (PCTIS) consisting of a sub-wavelength patterned metallic cladding 16 on a dielectric substrate 10, which may have a thickness d 12. The side 14 of the dielectric substrate 10 opposite the patterned metallic cladding 16 may be grounded. The dispersion equation of a printed-circuit tensor impedance surface consisting of a patterned metallic cladding over a grounded dielectric substrate in accordance with the prior art is given by the following equation $$Y_{sheet}(\theta) = -\begin{pmatrix} Y0\frac{k0}{kz0} & 0 \\ 0 & Y0\frac{kz0}{k0} \end{pmatrix} + j * Y1 * \cot(kz1 * d) * \begin{pmatrix} \frac{k1}{kz1} & 0 \\ 0 & \frac{kz1}{k1} \end{pmatrix} \frac{1}{kz1k1} \begin{pmatrix} (k1-ky)\wedge 2 & kxky \\ kxky & (k1-kx)\wedge 2 \end{pmatrix}$$

where

Ysheet is the homogenized sheet admittance representing the lumped elements,

Y0 is the wave admittance of free space=1/(120*pi ohms),

Y1 is the wave admittance in the dielectric medium, k0 is the wavenumber of free space, k1 is the wave number in the dielectric medium, kz0 is the wavenumber component that is normal to the lumped element surface in free space, kz1 is the wavenumber component that is normal to the lumped element surface in the dielectric medium, kx and ky are components of the transverse wavenumber such that k0^2=kx^2+ky^2+kz0^2 and k1^2=kx^2+ky^2+kz1^2, and d is the thickness of the dielectric substrate.

In the prior art, the metallic cladding 16 is modeled as a tensor sheet impedance, as shown in FIG. 1. The values of surface impedance achievable are limited due to substrate thickness d 12 and fabrication tolerances. The sheet impedance is typically found for a given metallic pattern by using an extraction method as described in References 2 and 13 above, which are incorporated herein by reference.

Figure 2:
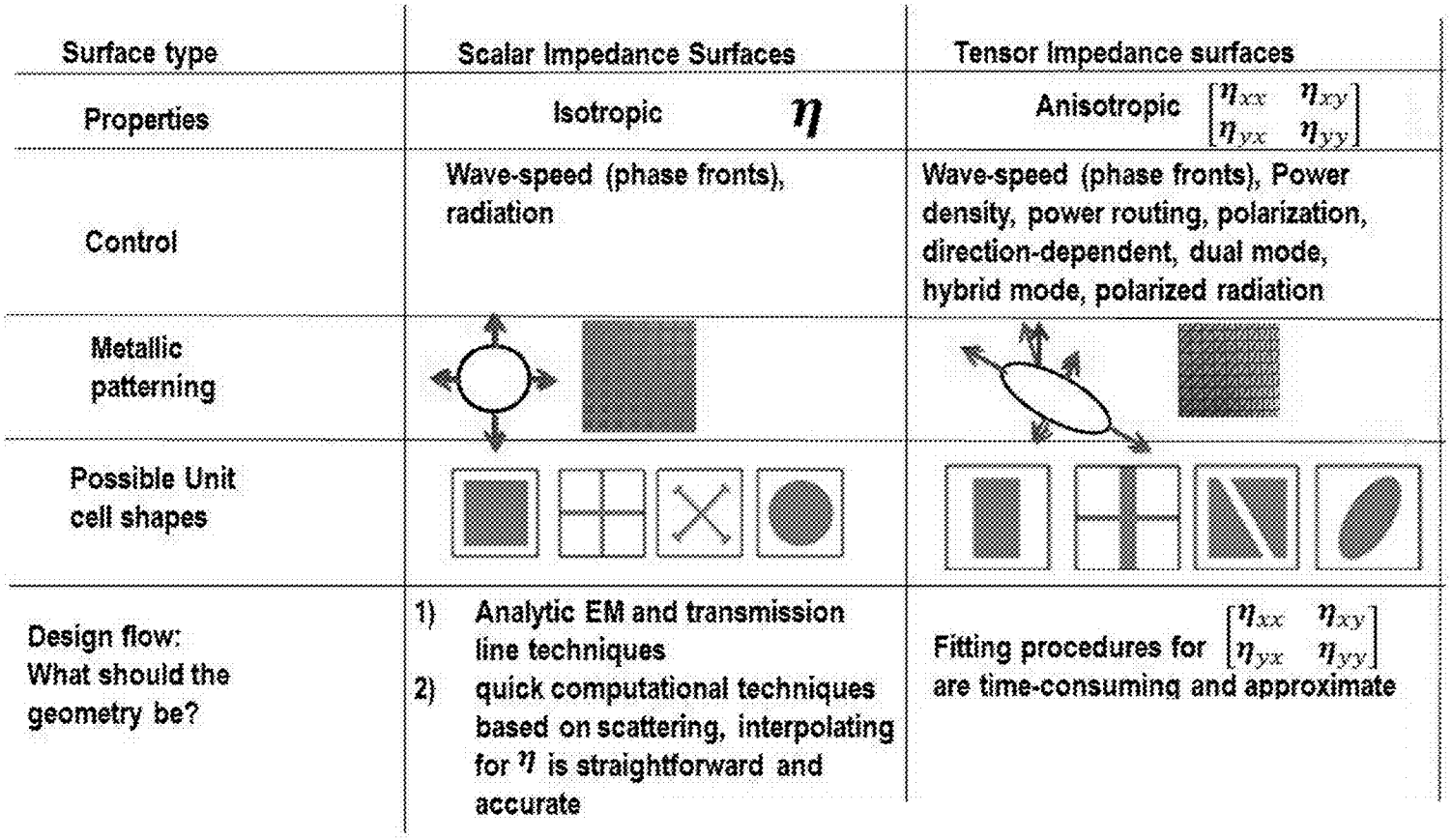
FIG. 2 PRIOR ART
FIG. 2 shows a table comparing features of scalar impedance surfaces to features of tensor impedance surfaces in accordance with the prior art.

The table in FIG. 2 compares features of scalar impedance surfaces to features of tensor impedance surfaces in the prior art. A scalar impedance surface may be isotropic, provide control of wave speed or the phase front, have unit cells with metallic patterning, use analytic electro-magnetic (EM} and transmission line techniques, and use relatively quick computational techniques. A tensor impedance surface may be anisotropic, and provide control of phase front, power density, power routing, and polarization. Prior art tensor impedance surface may also have unit cells with metallic patterning; however, as discussed above the procedures to attain a desired impedance surface in the prior art are computationally expensive, time consuming and approximate. Properties may be varied by varying geometrical parameters like gap-spacing; however, as discussed above, in the prior art the impedance ranges and anisotropy may be limited due to fabrication tolerances.

Figure 3B:
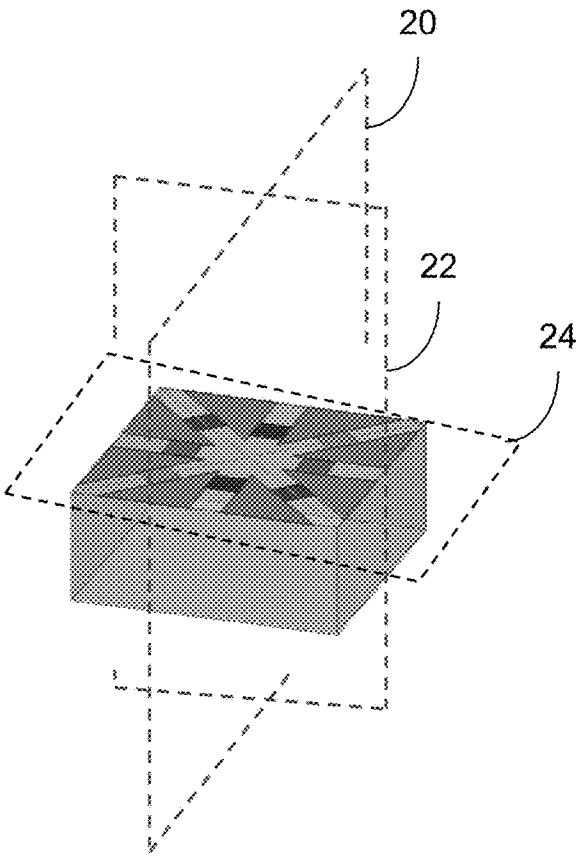
FIGS. 3A and 3B show diagrams of a lumped element unit cell having a fixed metallic structure with lumped element loading.
Figure 3A:
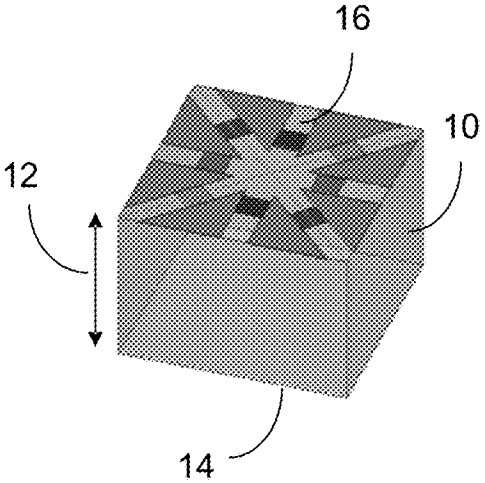
Figure 3D:
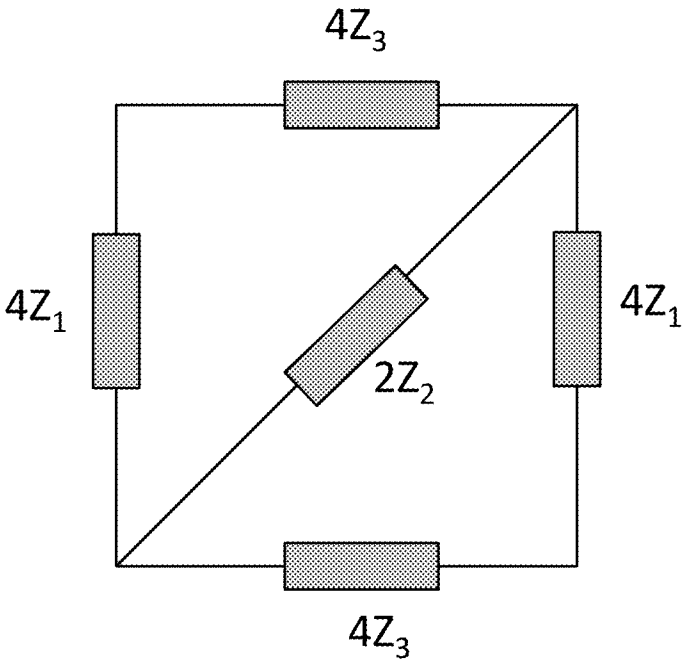
FIG. 3D shows a circuit model of the unit cell with lumped element loading for a 3-branch structure, or 3 circuit transmission line model.
Figure 3C:
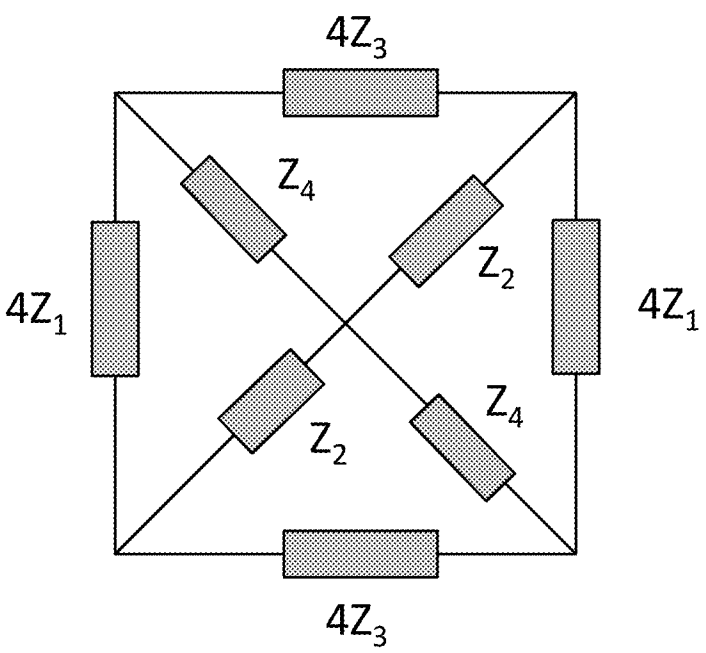
FIG. 3C shows a circuit model of the unit cell with lumped element loading for a 4-branch structure, or 4 circuit transmission line model.

FIGS. 3A and 3B show diagrams of a lumped element unit cell having a fixed metallic structure with lumped element loading in accordance with the present disclosure. FIG. 3C shows a circuit model of the unit cell of FIG. 3A with lumped element loading, and shows a 4-branch structure or 4 circuit transmission-line model used to represent the lumped element unit cell in accordance with the present disclosure. FIG. 3D also shows a circuit model of the unit cell of FIG. 3A with lumped element loading, and shows a 3-branch structure or 3 circuit transmission-line model used to represent the lumped element unit cell in accordance with the present disclosure.

Using the circuit model depicted in FIG. 3C, the sheet impedance can be found as a function of lumped circuit elements for a 4-branch structure by using the following dispersion equation.

$$Y_{sheet} = \begin{pmatrix} \frac{1}{2Z2} + \frac{1}{2Z3} + \frac{1}{2Z4} & \frac{1}{2Z2} - \frac{1}{2Z4} \\ \frac{1}{2Z2} - \frac{1}{2Z4} & \frac{1}{2Z2} + \frac{1}{2Z1} + \frac{1}{2Z4} \end{pmatrix}$$

The dispersion equation to solve then becomes:

$$\begin{pmatrix} \frac{1}{2Z2} + \frac{1}{2Z3} + \frac{1}{2Z4} & \frac{1}{2Z2} - \frac{1}{2Z4} \\ \frac{1}{2Z2} - \frac{1}{2Z4} & \frac{1}{2Z2} + \frac{1}{2Z1} + \frac{1}{2Z4} \end{pmatrix} = -\begin{pmatrix} Y0\frac{k0}{kz0} & 0 \\ 0 & Y0\frac{kz0}{k0} \end{pmatrix} +$$

$$j * Y1 * \cot(kz1 * d) * \begin{pmatrix} \frac{k1}{kz1} & 0 \\ 0 & \frac{kz1}{k1} \end{pmatrix} \frac{1}{kz1k1} \begin{pmatrix} (k1 - ky) \wedge 2 & kxky \\ kxky & (k1 - kx) \wedge 2 \end{pmatrix}$$

where

Ysheet is the homogenized sheet admittance representing the lumped elements,

Y0 is the wave admittance of free space=1/(120*pi ohms),

Y1 is the wave admittance in the dielectric medium, k0 is the wavenumber of free space, k1 is the wave number in the dielectric medium, kz0 is the wavenumber component that is normal to the lumped element surface in free space, kz1 is the wavenumber component that is normal to the lumped element surface in the dielectric medium, kx and ky are components of the transverse wavenumber such that k0^2=kx^2+ky^2+kz0^2 and k1^2=kx^2+ky^2+kz1^2, and d is the thickness of the dielectric substrate.

The dispersion equation above can be used to derive the lumped element impedances ($Z_n$) rather than the surface impedances/admittances (Ysheet/Zsheet matrices). Once the lumped impedances Z1, Z2, Z3, and Z4 are found, the appropriate lumped element values, which may be capacitors, inductors, diodes and/or resistors can be found. Advantageously, lumped elements such as capacitors, inductors, and resistors are low cost and are available in a large range of values. However, such lumped elements are generally only available in discrete values, so that factor can also be taken into account.

The above equations are for a 4-branch structure, but a similar model may be derived for a 3-branch structure, or 3 circuit transmission line model, as shown in FIG. 3D. For a 3-branch structure, the equation for $Y_{sheet}$ is the following.

$$Y_{sheet} = \begin{pmatrix} Y_{xx} & Y_{xy} \\ Y_{yx} & Y_{yy} \end{pmatrix} = \begin{pmatrix} \frac{1}{2Z_2} + \frac{1}{2Z_3} & \frac{1}{2Z_2} \\ \frac{1}{2Z_2} & \frac{1}{2Z_2} + \frac{1}{2Z_1} \end{pmatrix}$$

which is equivalent to:

$$Z_{sheet} = \begin{pmatrix} \frac{2Z_3(Z_1 + Z_2)}{Z_1 + Z_2 + Z_3} & \frac{-2Z_1Z_3}{Z_1 + Z_2 + Z_3} \\ \frac{-2Z_1Z_3}{Z_1 + Z_2 + Z_3} & \frac{2Z_1(Z_3 + Z_2)}{Z_1 + Z_2 + Z_3} \end{pmatrix}$$

The impedance of the circuit elements may be found in terms of the desired surface admittance, as follows.

$$Z_1 = \frac{1}{2(Yxx - Yxy)}, Z_2 = \frac{1}{2Yxy}, Z_3 = \frac{1}{2(Yyy - Yxy)}$$

Figure 3E:
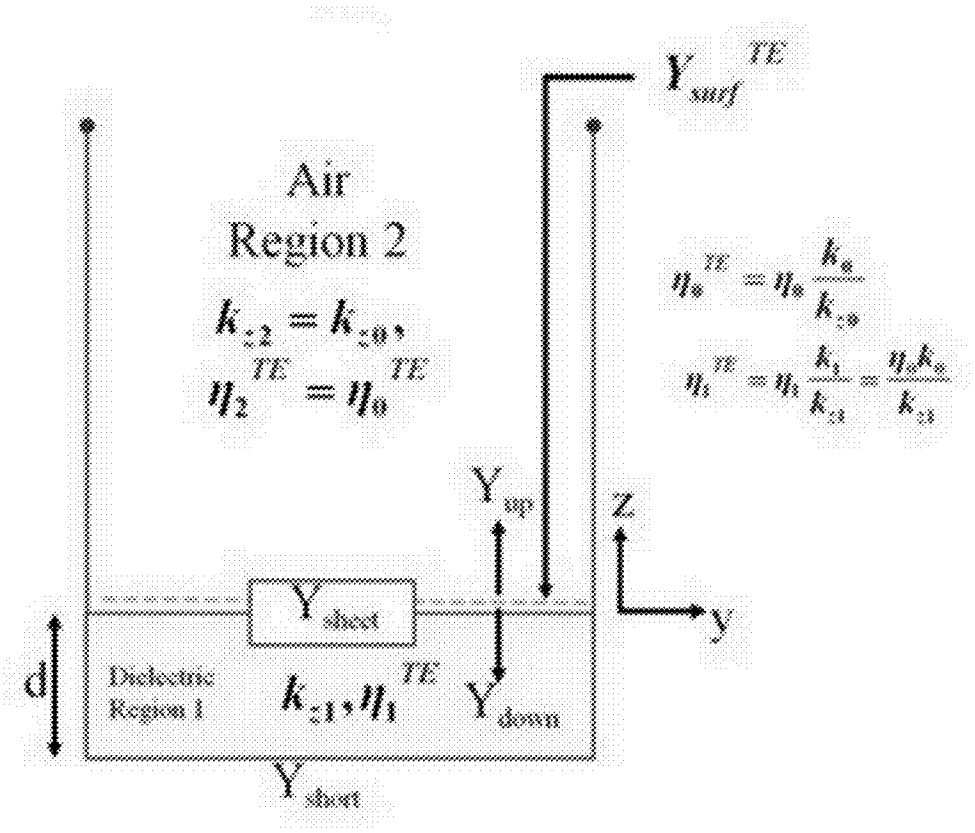
FIGS. 3E and 3F show 3 circuit transmission-line models used to represent a 3-branch structure lumped element unit cell in accordance with the present disclosure.
Figure 3F:
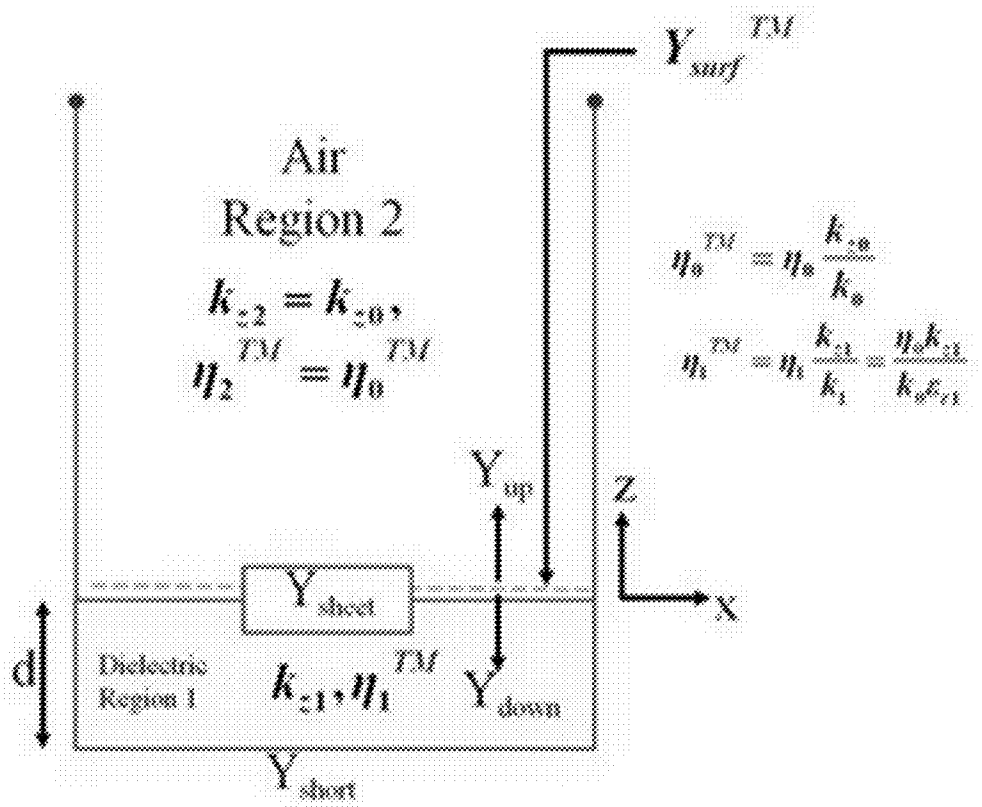

FIGS. 3E and 3F show 3 circuit transmission-line models used to represent the lumped element unit cell for a 3-branch structure in accordance with the present disclosure. FIG. 3E shows the circuit model for the transverse electric surface modes, as shown by dotted line 20 in FIG. 3B. FIG. 3F shows the circuit model for the transverse magnetic surface modes, as shown by dotted line 22 in FIG. 3B. The transverse electric circuit model of FIG. 3E needs to be used together with the transverse magnetic circuit model shown in FIG. 3F to capture the mixed modes of the structure. In the circuit models $Y_{sheet}$ is as shown above for the 3-branch structure and $$Ysurf = -\begin{pmatrix} Y0\frac{k0}{kz0} & 0 \\ 0 & Y0\frac{kz0}{k0} \end{pmatrix}$$

The plane 24 with lumped elements is modeled as a homogenous sheet impedance using $Y_{sheet}$ or equivalently $Z_{sheet}$, as shown above.

Figure 4:
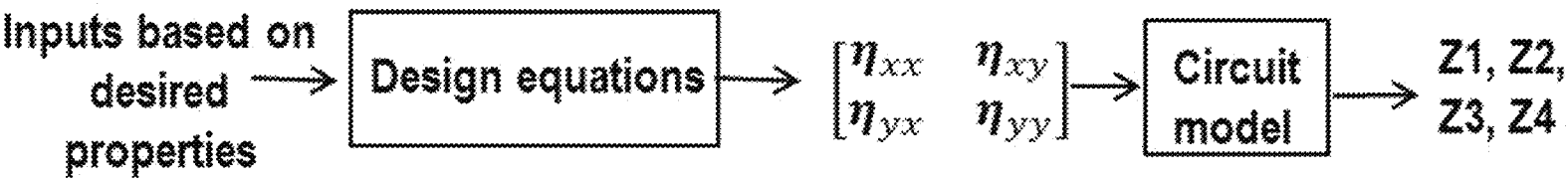
FIG. 4 shows a design flow for realizing lumped element metasurfaces based on a set of desired properties such as frequency, direction of desired phase flow, direction of desired power flow, and proportion of TM to TE field in accordance with the present disclosure.

Lumped element tensor impedance surfaces along with the circuit models aid direct synthesis and provide a complete design flow. FIG. 4 shows a design flow for realizing lumped element metasurfaces based on a set of desired properties. The desired properties may include frequency, direction of desired phase flow, direction of desired power flow, and polarization control by controlling the proportion of TM to TE field.

Figure 5A:
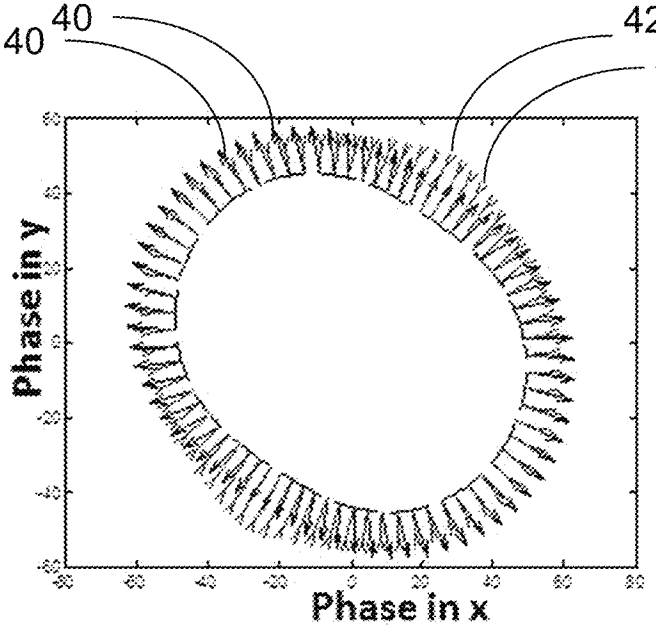
FIGS. 5A and 5B show two different dispersion diagrams at 10 GHz for two different tensor surface unit cells with the same physical geometry but different lumped elements for Z1, Z2, and Z3 in accordance with the present disclosure.
Figure 5B:
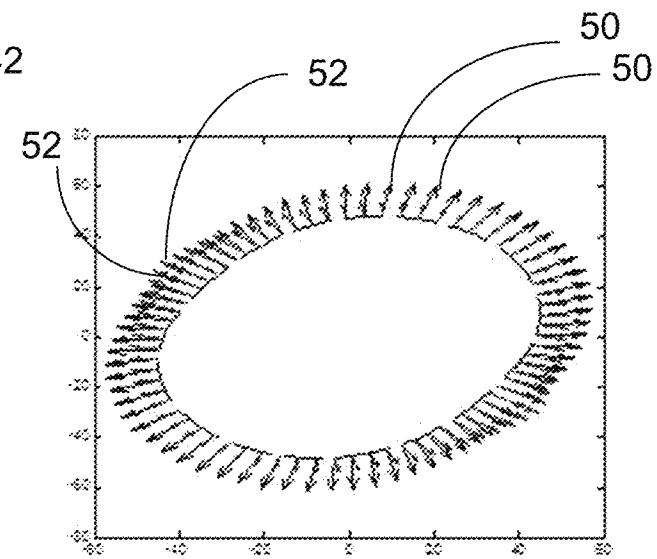

FIGS. 5A and 5B show examples of two different dispersion diagrams at 10 GHz for two different tensor surface unit cells with the same physical geometry but different lumped elements for Z1, Z2, and Z3. In FIG. 5A the tensor surface unit cells are loaded with all capacitors having values of C1=80 fF, C2=50 fF and C3=0.15 pF. In FIG. 5B the tensor surface unit cells are loaded with 2 capacitors and one inductor having values of C1=0.2 pF, L2=4.5 nH and C3=0.18 pF. In FIGS. 5A and 5B the arrows 40 and 50 represent phase velocity direction, and the arrows 42 and 52 represent the Poynting vector direction, which is the power flow direction. The dispersion diagrams of FIGS. 5A and 5B are anisotropic dispersion diagrams, because an isotropic dispersion diagram would be a perfect circle with the arrows 40 and 42, and the arrows 50 and 52 overlapping exactly at all points along the circle.

FIGS. 5A and 5B demonstrate how with the units cells described in this disclosure, two unit cells, which may look physically identical, can yield two very different sets of dispersion properties. Both unit cells may look like a metallic grid loaded with surface mount lumped elements. The reason for different sets of dispersion properties is because the anisotropic capacitive and inductive loading is achieved using a fixed metal grid but with varying lumped element values.

In prior art, achieving two dramatically different dispersion properties requires that the metallic patterns be geometrically different since the inductance and capacitance in the prior art is achieved from the widths of the metallic gaps and traces. In this disclosure, the inductance and capacitance is achieved primary from the lumped elements with the grid providing a negligible contribution.

A 3-branch structure was used to derive the lumped elements for FIGS. 5A and 5B. The advantage of a 3 branch structure is that fewer lumped elements are needed. However, a 4-branch structure, as illustrated by the example shown in FIGS. 3A and 3B, has more design flexibility because one of the impedances is a free parameter.

Figure 6:
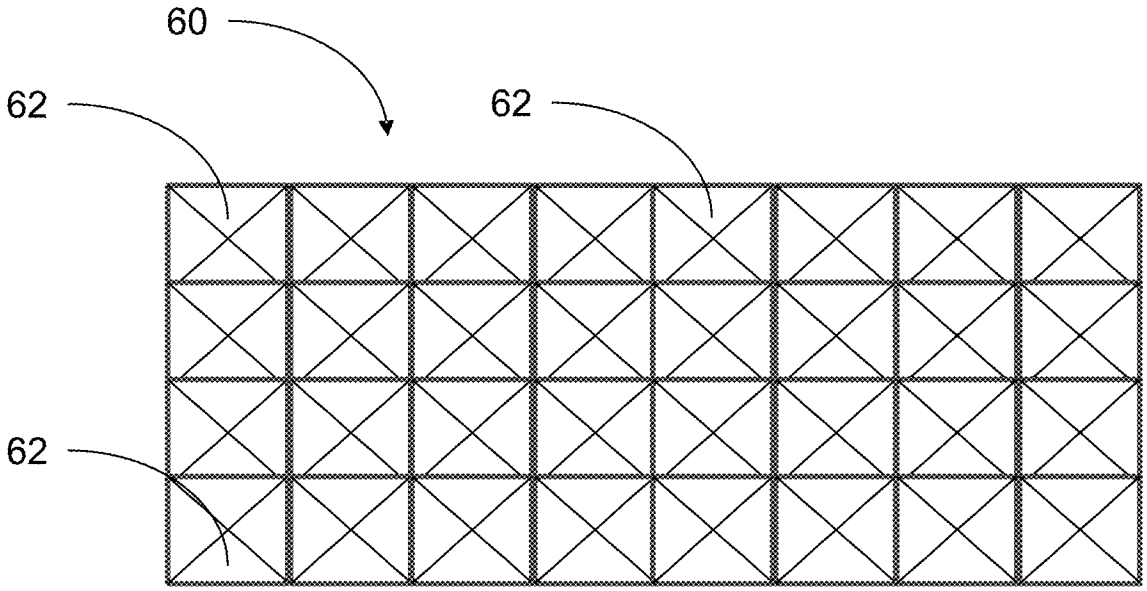
FIG. 6 shows a top view of a tensor impedance surface showing a tensor impedance surface with adjacent unit cells in accordance with the present disclosure.

FIG. 6 shows a top view of a tensor impedance surface showing a tensor impedance surface 60 with adjacent unit cells 62 in accordance with the present disclosure. Each of the unit cells 62 may have an identical metallic pattern, or a few different metallic patterns. Visually, the tensor impedance surface may look uniform throughout. The surface properties are varied locally at a unit cell 62 by loading the metallic patterns of the unit cell 62 with lumped element values that may be different than the lumped element values for another unit cell 62. The result is an inhomogeneous and anisotropic surface.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A tensor impedance surface comprising:

a plurality of unit cells, wherein each unit cell comprises:

a dielectric having a thickness;

a first surface of the dielectric having a metallic pattern on the first surface; and at least one lumped element coupled between a first point on the metallic pattern and a second point on the metallic pattern;

wherein each unit cell of the plurality of unit cells has a first thickness;

wherein each unit cell of the plurality of unit cells has an identical metallic pattern; and wherein each unit cell of the plurality of unit cells is adjacent to one or more unit cells of the plurality of the unit cells.

2. The tensor impedance surface of claim 1 wherein a second surface of the dielectric opposite the first surface is coupled to a ground.

3. The tensor impedance surface of claim 1 wherein the dielectric comprises a printed circuit board.

4. The tensor impedance surface of claim 1 wherein the at least one lumped element comprises a capacitor, an inductor, a resistor, or a diode.

5. The tensor impedance surface of claim 1:

wherein the at least one lumped element comprises a 3-branch structure comprising:

at least a first lumped element, a second lumped element, and a third lumped element, the first lumped element coupled between a first point on the metallic pattern and a second point on the metallic pattern, the second lumped element coupled between a third point on the metallic pattern and a fourth point on the metallic pattern, and the third lumped element coupled between a fifth point on the metallic pattern and a sixth point on the metallic pattern.

6. The tensor impedance surface of claim 5:

wherein the first lumped element comprises a capacitor, an inductor, a resistor, or a diode;

wherein the second lumped element comprises a capacitor, an inductor, a resistor, or a diode; and wherein the third lumped element comprises a capacitor, an inductor, a resistor, or a diode.

7. The tensor impedance surface of claim 6:

wherein values of the first lumped element, the second lumped element, the third lumped element and the fourth lumped element are derived by solving $$Z_1 = \frac{1}{2(Yxx - Yxy)},\ Z_2 = \frac{1}{2Yxy},\ Z_3 = \frac{1}{2(Yyy - Yxy)}$$

$w^{\neg}$ $$Y_{sheet} = \begin{pmatrix} Y_{xx} & Y_{xy} \\ Y_{yx} & Y_{yy} \end{pmatrix} = \begin{pmatrix} \frac{1}{2Z_2} + \frac{1}{2Z_3} & \frac{1}{2Z_2} \\ \frac{1}{2Z_2} & \frac{1}{2Z_2} + \frac{1}{2Z_1} \end{pmatrix}$$

which is equivalent to:

$$Z_{sheet} = \begin{pmatrix} \frac{2Z_3(Z_1 + Z_2)}{Z_1 + Z_2 + Z_3} & \frac{-2Z_1Z_3}{Z_1 + Z_2 + Z_3} \\ \frac{-2Z_1Z_3}{Z_1 + Z_2 + Z_3} & \frac{2Z_1(Z_3 + Z_2)}{Z_1 + Z_2 + Z_3} \end{pmatrix}$$

where the first lumped element is Z1;

where the second lumped element is Z2; and where the third lumped element is Z3.

8. The tensor impedance surface of claim 1:

wherein the at least one lumped element comprises a 4-branch structure comprising:

at least a first lumped element, a second lumped element, a third lumped element and a fourth lumped element, the first lumped element coupled between a first point on the metallic pattern and a second point on the metallic pattern, the second lumped element coupled between a third point on the metallic pattern and a fourth point on the metallic pattern, the third lumped element coupled between a fifth point on the metallic pattern and a sixth point on the metallic pattern, and the fourth lumped element coupled between a seventh point on the metallic pattern and a eighth point on the metallic pattern.

9. The tensor impedance surface of claim 8:

wherein values of the first lumped element, the second lumped element, the third lumped element and the fourth lumped element are derived by solving $$\begin{pmatrix} \frac{1}{2Z2} + \frac{1}{2Z3} + \frac{1}{2Z4} & \frac{1}{2Z2} - \frac{1}{2Z4} \\ \frac{1}{2Z2} - \frac{1}{2Z4} & \frac{1}{2Z2} + \frac{1}{2Z1} + \frac{1}{2Z4} \end{pmatrix} = -\begin{pmatrix} Y0\frac{k0}{kz0} & 0 \\ 0 & Y0\frac{kz0}{k0} \end{pmatrix} +$$

-continued $$j * Y1 * \cot(kz1 * d) * \begin{pmatrix} \frac{k1}{kz1} & 0 \\ 0 & \frac{kz1}{k1} \end{pmatrix} \frac{1}{kz1k1} \begin{pmatrix} (k1 - ky) \wedge 2 & kxky \\ kxky & (k1 - kx) \wedge 2 \end{pmatrix}$$

where the first lumped element is Z1;

where the second lumped element is Z2;

where the third lumped element is Z3;

where the fourth lumped element is Z4; and where

Ysheet is the homogenized sheet admittance representing the lumped elements,

Y0 is the wave admittance of free space=1/(120*pi ohms),

Y1 is the wave admittance in the dielectric medium, k0 is the wavenumber of free space, k1 is the wave number in the dielectric medium, kz0 is the wavenumber component that is normal to the lumped element surface in free space, kz1 is the wavenumber component that is normal to the lumped element surface in the dielectric medium, kx and ky are components of the transverse wavenumber such that k0^2=kx^2+ky^2+kz0^2 and k1^2=kx^2+ky^2+kz1^2, and d is the thickness of the dielectric substrate.

10. The tensor impedance surface of claim 8:

wherein the first lumped element comprises a capacitor, an inductor, a resistor, or a diode;

wherein the second lumped element comprises a capacitor, an inductor, a resistor, or a diode;

wherein the third lumped element comprises a capacitor, an inductor, a resistor, or a diode; and wherein the fourth lumped element comprises a capacitor, an inductor, a resistor, or a diode.

11. The tensor impedance surface of claim 1:

wherein the unit cell is configured to control one or more of phase direction, power flow direction, and polarization.

12. A method of providing a tensor impedance surface comprising:

providing a plurality of unit cells, wherein each unit cell comprises:

a dielectric having a thickness;

a first surface of the dielectric having a metallic pattern on the first surface; and at least one lumped element coupled between a first point on the metallic pattern and a second point on the metallic pattern;

wherein each unit cell of the plurality of unit cells has a first thickness;

wherein each unit cell of the plurality of unit cells has an identical metallic pattern; and wherein each unit cell of the plurality of unit cells is adjacent to one or more unit cells of the plurality of the unit cells.

13. The method of claim 12 wherein a second surface of the dielectric opposite the first surface is coupled to a ground.

14. The method of claim 12 wherein the dielectric comprises a printed circuit board.

15. The method of claim 12 wherein the at least one lumped element comprises a capacitor, an inductor, a resistor, or a diode.

16. The method of claim 12:

wherein the at least one lumped element comprises a 3-branch structure comprising:

at least a first lumped element, a second lumped element, and a third lumped element, the first lumped element coupled between a first point on the metallic pattern and a second point on the metallic pattern, the second lumped element coupled between a third point on the metallic pattern and a fourth point on the metallic pattern, and the third lumped element coupled between a fifth point on the metallic pattern and a sixth point on the metallic pattern.

17. The method of claim 16:

wherein the first lumped element comprises a capacitor, an inductor, a resistor, or a diode;

wherein the second lumped element comprises a capacitor, an inductor, a resistor, or a diode; and wherein the third lumped element comprises a capacitor, an inductor, a resistor, or a diode.

18. The method of claim 17:

wherein values of the first lumped element, the second lumped element, the third lumped element and the fourth lumped element are derived by solving $$Z_1 = \frac{1}{2(Yxx - Yxy)},\ Z_2 = \frac{1}{2Yxy},\ Z_3 = \frac{1}{2(Yyy - Yxy)}$$

$w^{\neg}$ $$Y_{sheet} = \begin{pmatrix} Y_{xx} & Y_{xy} \\ Y_{yx} & Y_{yy} \end{pmatrix} = \begin{pmatrix} \frac{1}{2Z_2} + \frac{1}{2Z_3} & \frac{1}{2Z_2} \\ \frac{1}{2Z_2} & \frac{1}{2Z_2} + \frac{1}{2Z_1} \end{pmatrix}$$

which is equivalent to:

$$Z_{sheet} = \begin{pmatrix} \frac{2Z_3(Z_1 + Z_2)}{Z_1 + Z_2 + Z_3} & \frac{-2Z_1Z_3}{Z_1 + Z_2 + Z_3} \\ \frac{-2Z_1Z_3}{Z_1 + Z_2 + Z_3} & \frac{2Z_1(Z_3 + Z_2)}{Z_1 + Z_2 + Z_3} \end{pmatrix}$$

where the first lumped element is Z1;

where the second lumped element is Z2; and where the third lumped element is Z3.

19. The method of claim 12:

wherein the at least one lumped element comprises a 4-branch structure comprising:

at least a first lumped element, a second lumped element, a third lumped element and a fourth lumped element, the first lumped element coupled between a first point on the metallic pattern and a second point on the metallic pattern, the second lumped element coupled between a third point on the metallic pattern and a fourth point on the metallic pattern, the third lumped element coupled between a fifth point on the metallic pattern and a sixth point on the metallic pattern, and the fourth lumped element coupled between a seventh point on the metallic pattern and a eighth point on the metallic pattern.

20. The method of claim 19:

wherein values of the first lumped element, the second lumped element, the third lumped element and the fourth lumped element are derived by solving $$\begin{pmatrix} \frac{1}{2Z2} + \frac{1}{2Z3} + \frac{1}{2Z4} & \frac{1}{2Z2} - \frac{1}{2Z4} \\ \frac{1}{2Z2} - \frac{1}{2Z4} & \frac{1}{2Z2} + \frac{1}{2Z1} + \frac{1}{2Z4} \end{pmatrix} = -\begin{pmatrix} Y0\frac{k0}{kz0} & 0 \\ 0 & Y0\frac{kz0}{k0} \end{pmatrix} +$$

$$j * Y1 * \cot(kz1 * d) * \begin{pmatrix} \frac{k1}{kz1} & 0 \\ 0 & \frac{kz1}{k1} \end{pmatrix} \frac{1}{kz1k1} \begin{pmatrix} (k1 - ky) \wedge 2 & kxky \\ kxky & (k1 - kx) \wedge 2 \end{pmatrix}$$

where the first lumped element is Z1;

where the second lumped element is Z2;

where the third lumped element is Z3;

where the fourth lumped element is Z4; and where

Ysheet is the homogenized sheet admittance representing the lumped elements,

Y0 is the wave admittance of free space=1/(120*pi ohms),

Y1 is the wave admittance in the dielectric medium, k0 is the wavenumber of free space, k1 is the wave number in the dielectric medium, kz0 is the wavenumber component that is normal to the lumped element surface in free space, kz1 is the wavenumber component that is normal to the lumped element surface in the dielectric medium, kx and ky are components of the transverse wavenumber such that k0^2=kx^2+ky^2+kz0^2 and k1^2=kx^2+ky^2+kz1^2, and d is the thickness of the dielectric substrate.

21. The method of claim 19:

wherein the first lumped element comprises a capacitor, an inductor, a resistor, or a diode;

wherein the second lumped element comprises a capacitor, an inductor, a resistor, or a diode;

wherein the third lumped element comprises a capacitor, an inductor, a resistor, or a diode; and wherein the fourth lumped element comprises a capacitor, an inductor, a resistor, or a diode.

22. The method of claim 12:

wherein the unit cell is configured to control one or more of phase direction, power flow direction, and polarization.

* * * * *